US006622317B1

(12) United States Patent
Oropallo et al.

(10) Patent No.: US 6,622,317 B1
(45) Date of Patent: Sep. 23, 2003

(54) PLUMBING FITTING COVER CAP RETENTION SYSTEM

(76) Inventors: Robert A. Oropallo, 1560 Kensington Rd., San Marino, CA (US) 91108; Anthony Oropallo, Jr., 1146 Altura Ter., Arcadia, CA (US) 91007

( * ) Notice: Subject to any disclaimer, the term of this patent is extended or adjusted under 35 U.S.C. 154(b) by 0 days.

(21) Appl. No.: 10/365,749

(22) Filed: Feb. 14, 2003

Related U.S. Application Data

(62) Division of application No. 10/112,844, filed on Mar. 28, 2002.

(51) Int. Cl.[7] ..... E03C 1/244
(52) U.S. Cl. ..... 4/494; 73/40.5 R; 138/90
(58) Field of Search ..... 4/694; 138/90; 73/40.5 R

(56) References Cited

U.S. PATENT DOCUMENTS 5,025,509 A * 6/1991 Holt et al. ..... 4/694
5,257,648 A * 11/1993 Oropallo ..... 138/90
6,192,531 B1 * 2/2001 Fritz et al. ..... 4/679
6,289,532 B1 * 9/2001 Fritz et al. ..... 4/679

* cited by examiner

*Primary Examiner*—Charles E. Phillips
(74) *Attorney, Agent, or Firm*—William W. Haefliger

(57) ABSTRACT

A retention system for holding and mounting a cover cap to a plumbing fitting having a tubular terminal that projects at an opening through a bath or shower wall, comprising a retainer ring fitting on said tubular terminal and tightenable toward said wall, a series of retention cams on said ring and space about a longitudinal axis defined by the ring, there being gaps between successive cams, and there being retention shoulders on the cams, the retention shoulders facing in directions toward said wall, for retaining holders on the cover cap, after said holders have been passed longitudinally through said gaps and after the cap has then rotated to cause said holders to slidably engage the cams and became wedged against said retention shoulders.

3 Claims, 5 Drawing Sheets

11
13
2
15
10
2
50
16
18
19
17
20

3
10a
25
23
24
13
30
27
50
25
10
21
3

FIG. 10.
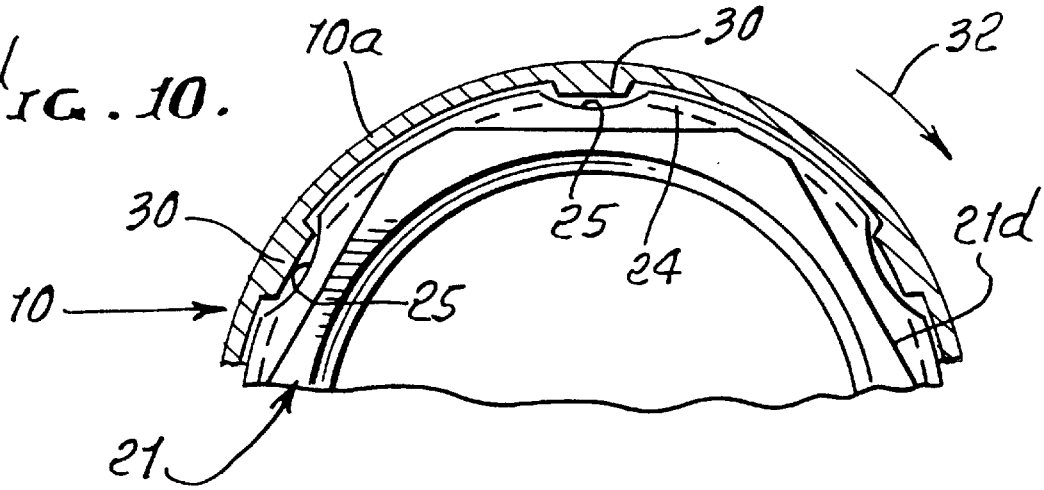
FIG. 11.
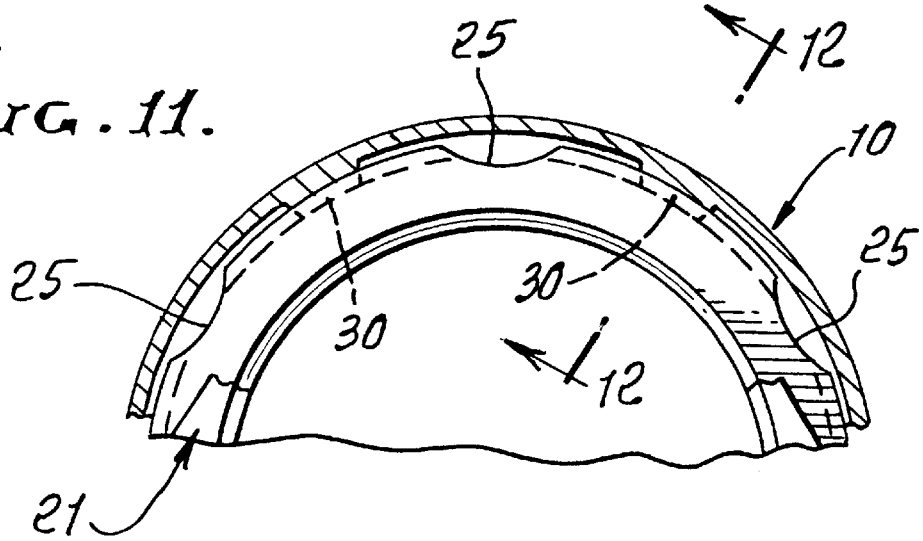
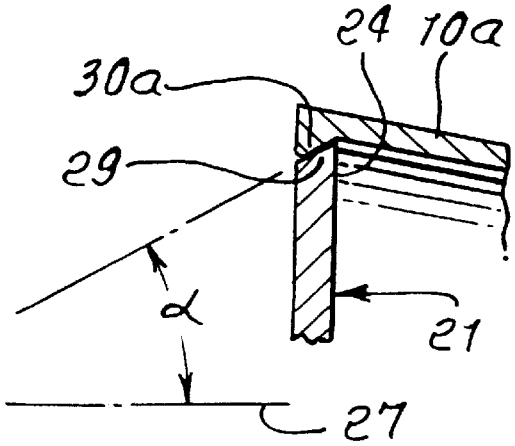
FIG. 12.

PLUMBING FITTING COVER CAP RETENTION SYSTEM

CROSS REFERENCES TO RELATED APPLICATION

This is a DIV of Ser. No. 10/112,844 filed Mar. 28, 2002.

BACKGROUND OF THE INVENTION

This intention relates generally to bath waste plumbing equipment, and more particularly retention of waste water outlet covers to terminals or outlets of plumbing fittings, as well as provision and use of caps for pressure testing of plumbing lines leading to such outlets.

There is continual need for improvements in such bath waste plumbing equipment, facilitating ease of application of such outlet covers to plumbing terminals as at bath or shower walls and removal of such covers; and there is need for equipment facilitating pressure testing of such plumbing lines leading to such terminals. No prior equipment of which we are aware incorporates the novel and highly useful cover and mounting structure of the present invention, or its functioning and improved results obtained.

SUMMARY OF THE INVENTION

It is a major object of the invention to provide highly useful improvements in plumbing equipment as referred to above. Basically, the invention is incorporated in a retention system for handling and mounting a cover cap to a plumbing fitting having a tubular terminal that projects at an opening through a wall, such as a bath or shower wall, and comprises:

a) a retainer ring fitting on the tubular terminal and tightenable toward the bath or shower wall, b) a series of retention cams on said ring and spaced about a longitudinal axis defined by the ring, there being gaps between successive cams, and there being retention shoulders on the cams, c) said retention shoulders facing in directions toward said wall, for retaining holders on the cover cap, after such holders have been passed longitudinally through said gaps, and after the cap has then been rotated to cause the holders to slidable engage the cams and become wedged against said retention shoulders.

It is another object to provide such a retainer ring having thread connection to the tubular terminal; and in this regard, the retainer ring may have wrench flats spaced axially from a plane defined by the retention cams on the ring.

A further object is to provide such a cap configured for attachment to the cams, which are receivable within the cap.

Yet another object is to provide a cap skirt carrying the holders positioned to be passed longitudinally forwardly through the gaps between circularly successive cams on the ring, the cap then being rotatable to cause the holders to slidably engage the cams and become wedged against retention shoulders on the cams. Such holders may comprise lips at the edge of the cap skirt, whereby the retained skirt may fit snugly against the wall at locations about the wall opening.

A further object is to provide a pressure test cap that is thread connected to the plumbing tubular terminal, and an annular seal carried by the pressure test cap in sealing engagement with an end face defined by said tubular terminal.

The method of pressure testing a plumbing fitting having a tubular terminal that projects at an opening through a wall includes the steps:

i) providing and rotatably connecting a pressure test cap to said terminal to terminal, thereby to seal off the tubular terminal, ii) applying internal fluid pressure to the fitting to determine if any fitting leakage exists, iii) thereafter rotatably removing the pressure test cap from the terminal, and iv) providing and rotatably connecting a cover cap onto that tubular terminal, to allow fluid leakage through the cover cap as during bath or shower usage.

These and other objects and advantages of the invention, as well as the details of an illustrative embodiment, will be more fully understood from the following specification and drawings, in which:

DRAWING DESCRIPTION

FIG. 10 is an axial view showing forward passage of holders on the cap skirt through gaps between circularly successive cams on the retainer ring;

FIG. 11 is a view like FIG. 10, but taken after the cap has been rotated to move the holders into wedged, cap retention position;

FIG. 12 is a further enlarged fragmentary view taken on lines 12—12 of FIG. 11, to show holder wedging;

DETAILED DESCRIPTION

Figure 1:
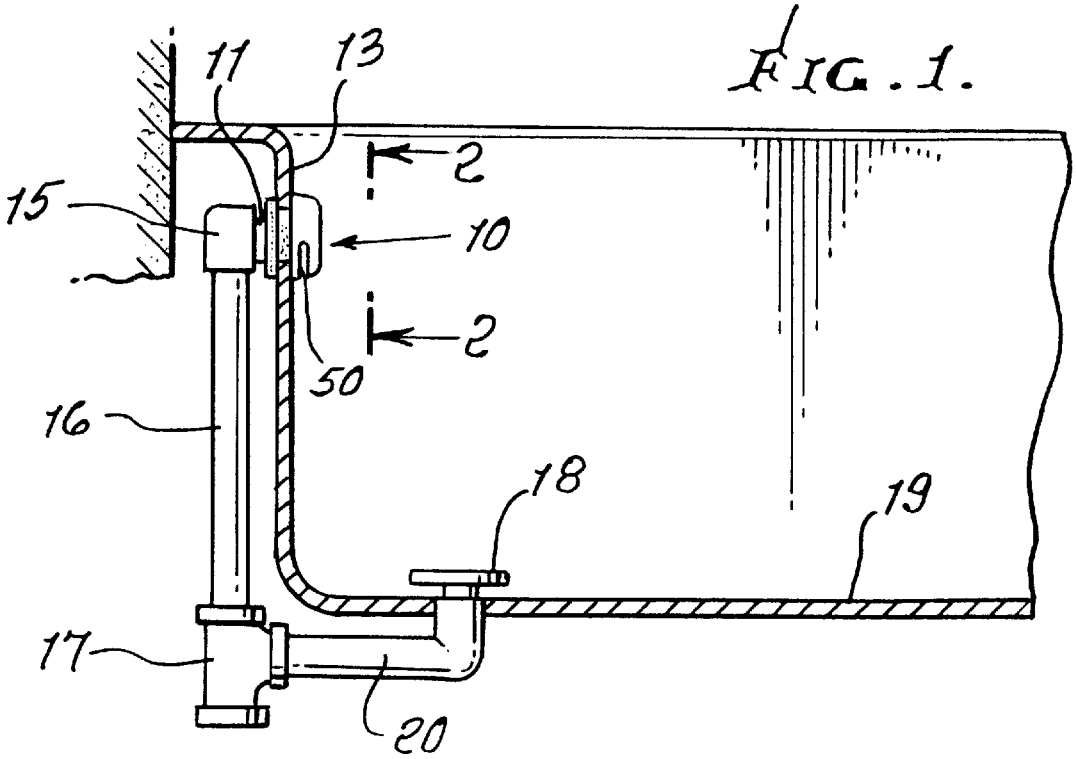
FIG. 1 is a simplified showing, in elevation, of waste plumbing leading from a tub or shower wall opening.
Figure 2:
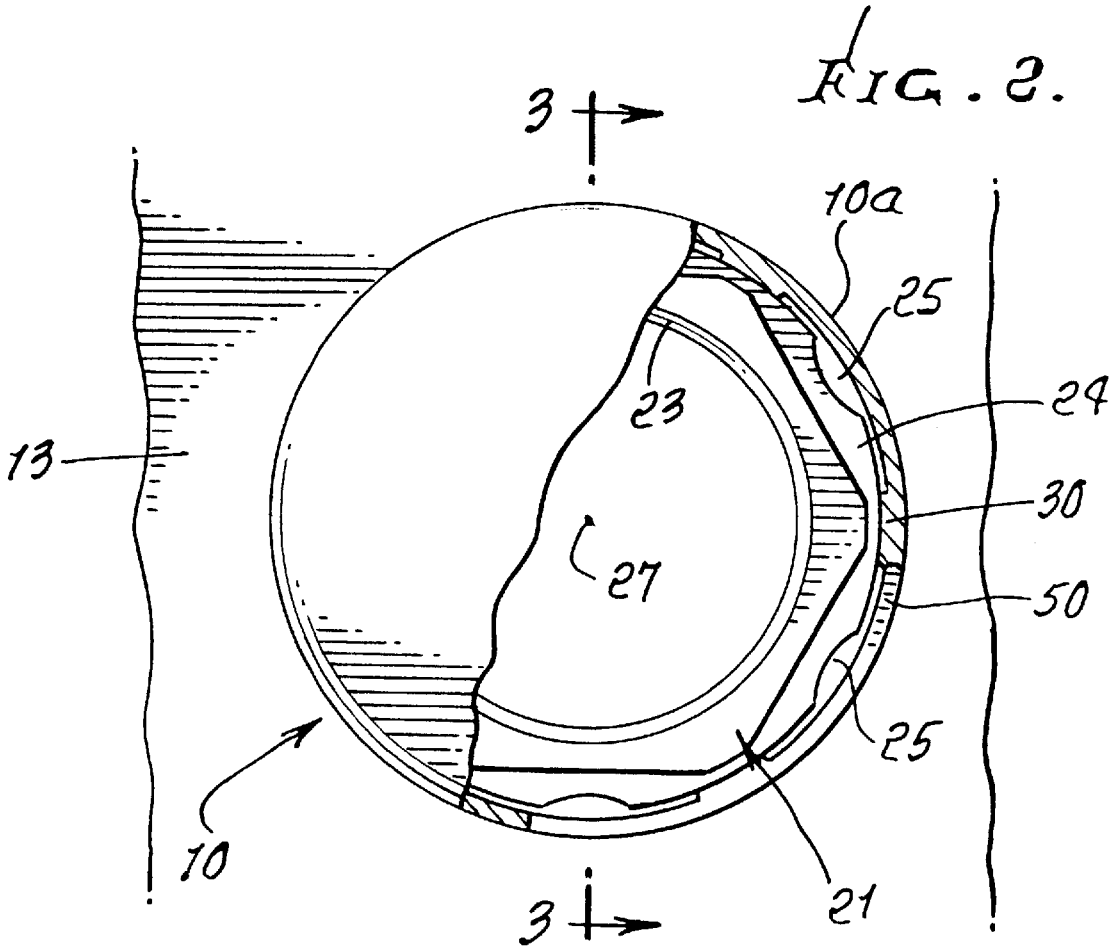
FIG. 2 is an enlarged elevation, partly broken away, and taken on lines 2—2 of FIG. 1.
Figure 3:
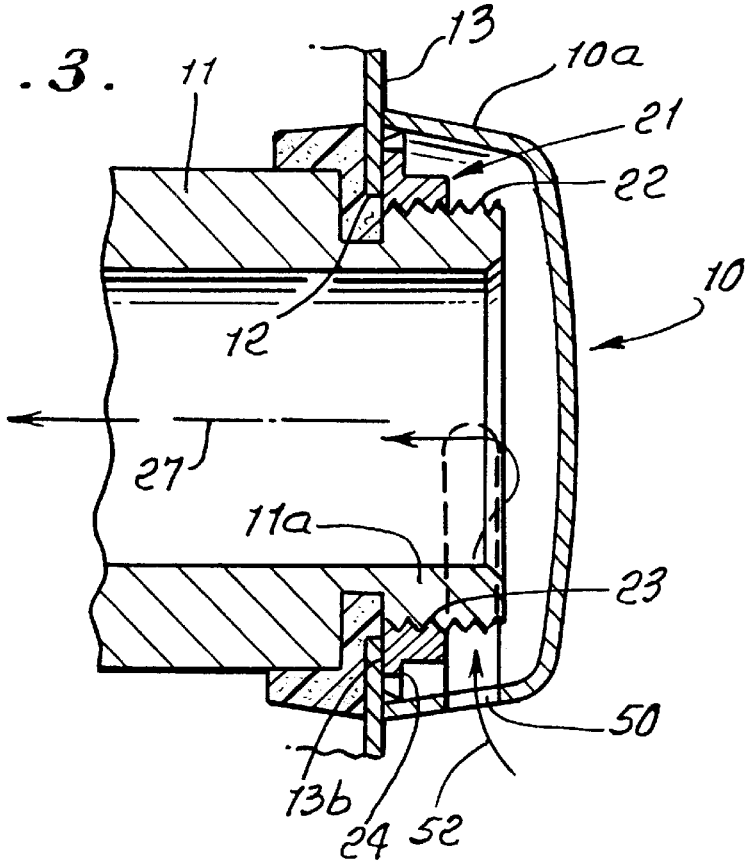
FIG. 3 is a section taken in elevation on lines 3—3 of FIG. 2.

FIGS. 1 and 3 show a cover cap 10 retained in position to cover a tubular terminal 11*a* of a plumbing line 11, projecting at or through an opening 12 in a bath or shower wall 13. A bath wall is illustrated, but is also representative of a shower wall. Merely for purposes of illustration, waste water plumbing line 11 may be connected by elbow 15 to a vertical duct 16, to which a tee 17 is connected. An outlet 18 at the tub or shower bottom wall 19 is also connected to the tee, as by waste line 20.

Figure 4:
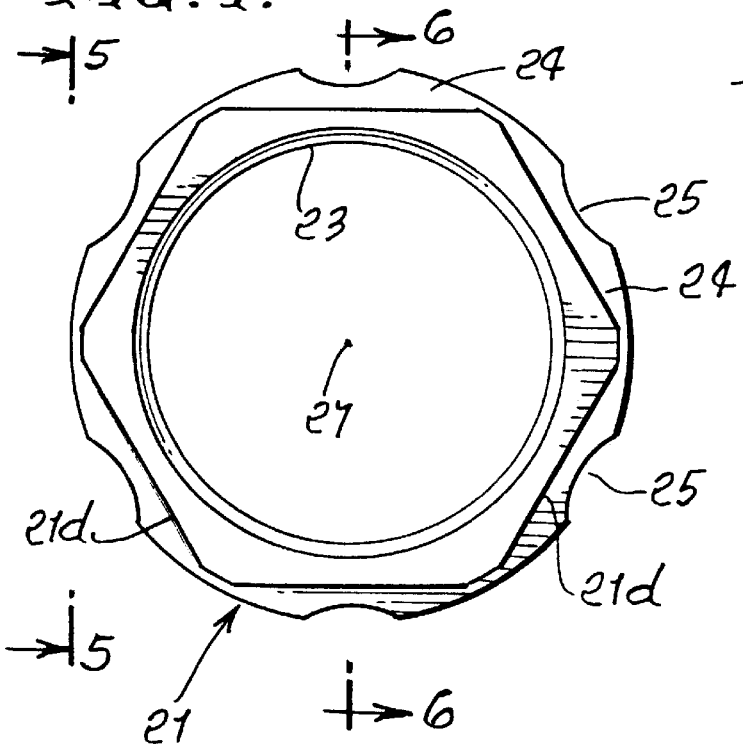
FIG. 4 is a frontal view taken in elevation, showing a retainer ring, as is also seen in section in FIG. 3.
Figure 5:
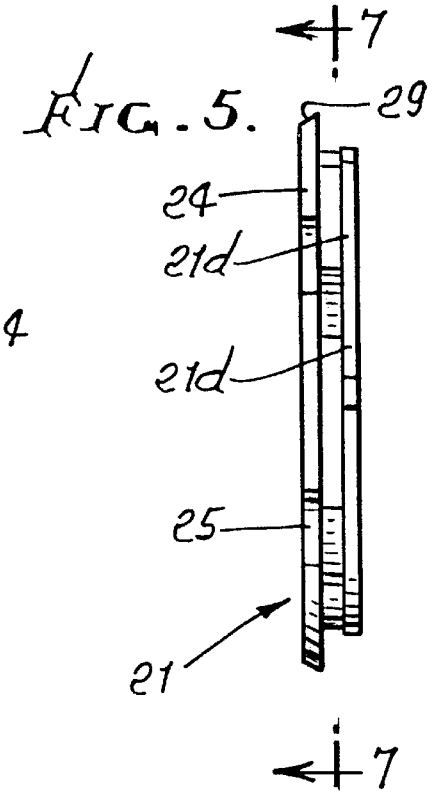
FIG. 5 is an edge elevation view taken on lines 5—5 of FIG. 4.
Figure 6:
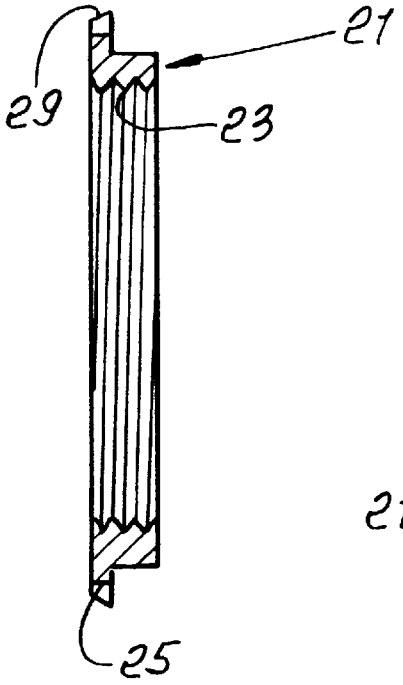
FIG. 6 is a section taken through the retainer ring, on lines 6—6 of FIG. 4.
Figure 7:
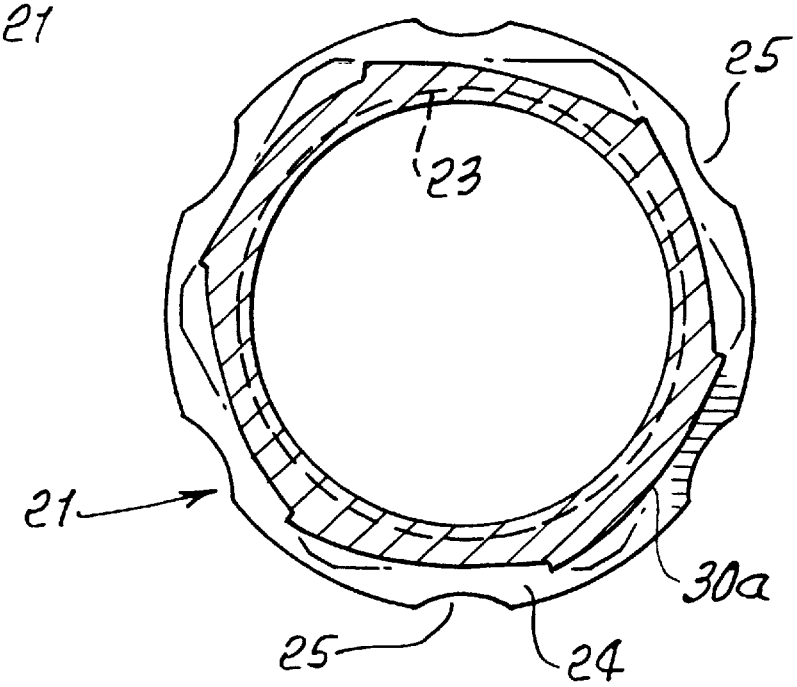
FIG. 7 is a section taken on lines 7—7 of FIG. 5 to show holder retention structure.

As shown in FIG. 3, a retainer ring 21 is fitted on terminal 11*a*. Such fitting may incorporate external threading 22 on 11*a*, and internal threading 23 on the ring, whereby the ring can be tightened toward wall 13, to frictionally position the ring adjacent the wall, as shown at 13*b*. FIG. 4 shows wrench flats 21*d* circularly spaced apart on the ring 21, and engageable by a wrench to facilitate such tightening.

In accordance with an important feature of the invention, the preferred ring 21 carries a series of like retention cams 24 spaced apart by gaps 25, and projecting outwardly at circularly spaced positions or intervals, about longitudinal axis 27 defined by the ring 21. Retention shoulders 29 are defined by the cams, at their sides which face wall 13, and are typically angled at angle a relative to axis 27, as seen in FIG. 12. Shoulders 29 face toward wall 13, due to such angling.

Figure 8:
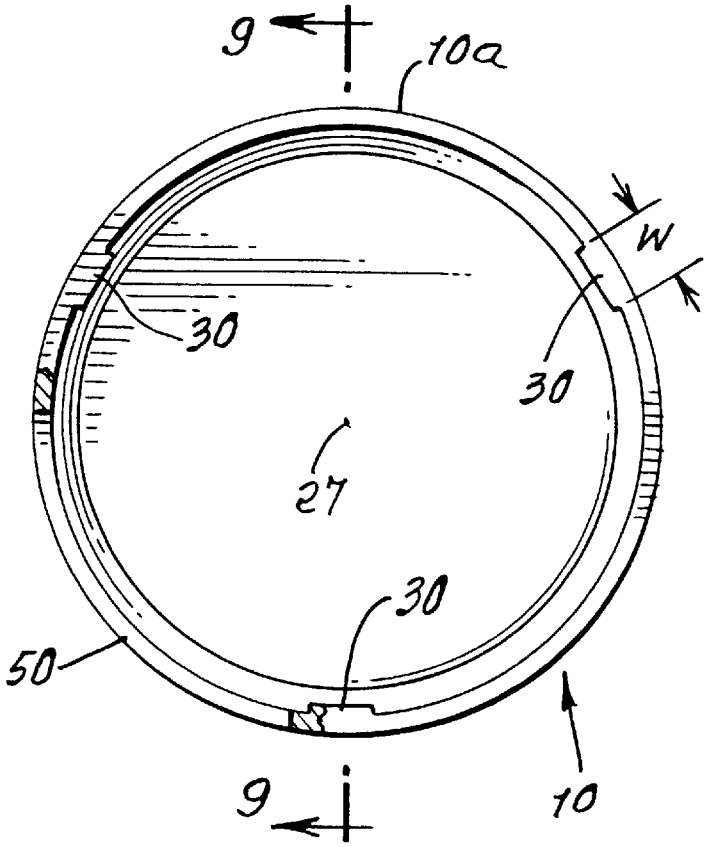
FIG. 8 is an axial elevation showing cap skirt and holder structure.
Figure 9:
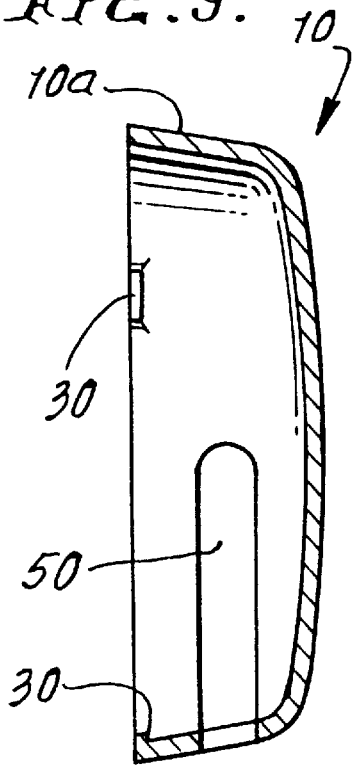
FIG. 9 is a section taken on lines 9—9 of FIG. 8.

The decorative cover cap 19, which conceals the ring 21, terminal 11*a* and threading 22 and 23, is adjustably retained to ring 21 as by a circularly spaced series of holders 30 formed on or carried by the cap skirt 10*a*. Such holders may comprise small lips, best seen in FIGS. 8 and 9, spaced circularly at angular intervals β, about axis 27. Three such lips, spaced at 0°, 120° and 240° about axis 27 are shown. Their width "ω" is such as to enable their passage through the gaps 25, as shown in FIG. 10, at the time of assembly of the cover cap to the ring 21. Once having passed through such gaps, the holders are in proximate or adjacent relation to wall 13; but the clearance are such as to allow cap and holder rotation as in direction 32 in FIG. 10, to wedgingly engage the cams 24. One way to accomplish this is to configure the holder lips 30 with surfaces 30*a* angled to wedgingly engage the retention shoulders 29 of the cams, as seen in FIG. 12. The interengagement is frictionally, and may allow for continued rotation of the cap to advance the holders beyond the interengaged cams, and to bring the holders into registration with the next in sequence gaps 25, enabling axial removal of the cap 10 from the ring 21. Reverse rotation of the cap also accomplishes the same objective. Accordingly, an easily installed and easily removed decorative and protective cap is provided for, the ring 21 also being easily installed and removed, as described.

Figure 13:
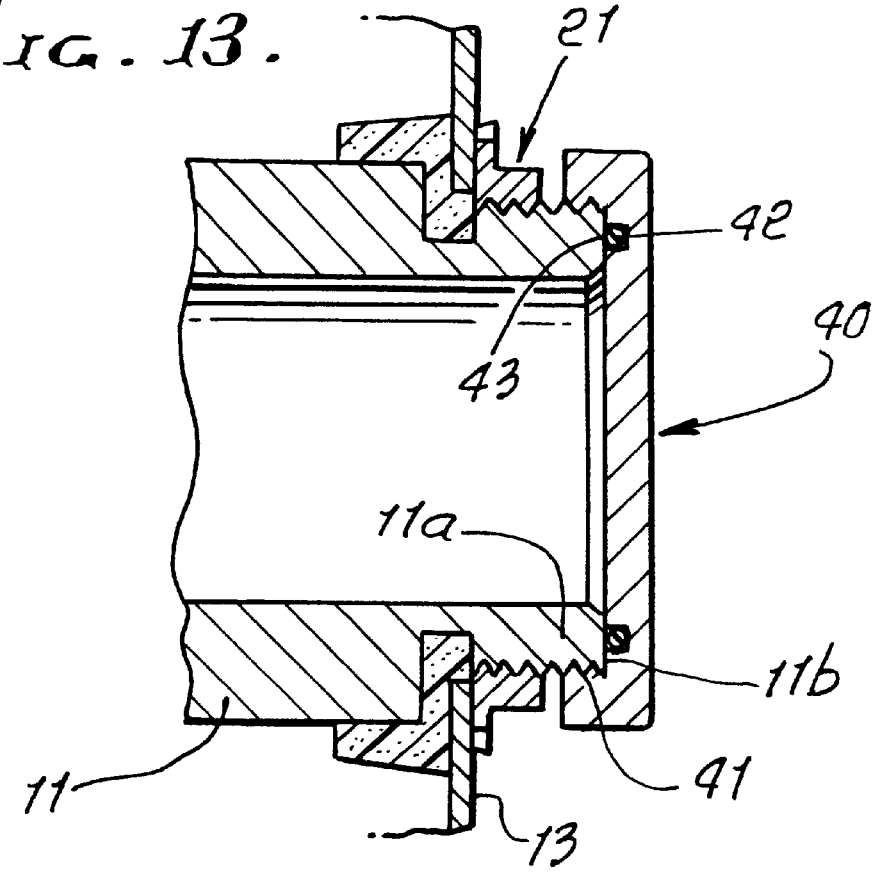
FIG. 13 is a section like FIG. 3, but showing a pressure test cap in retained and sealing position on the plumbing tubular terminal.
Figure 14:
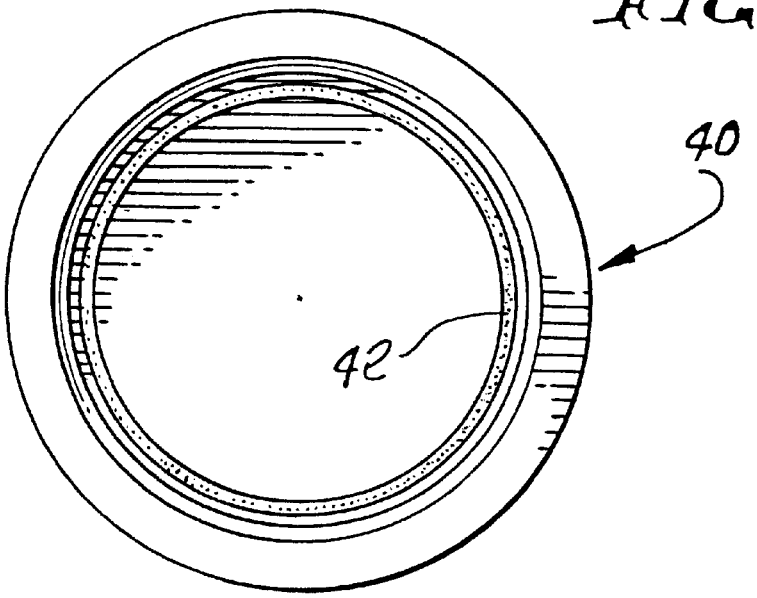
FIG. 14 is an axial view showing the seal ring carried by the pressure test cap.

FIGS. 13 and 14 show a pressure test cap 40 thread connected at 41 to the tubular terminal 13*a*, without requiring removal of ring 21. An annular seal 42 carried by that cap is brought into sealing engagement at 43 with the end face 13*b* defined by the plumbing terminal 13*a*, by tightening of the cap in the position shown. The construction allows quick removal of decorative cap 10, and quick installation of pressure test cap 40, for a testing of the plumbing for leaks. The method of testing a plumbing fitting having a tubular terminal that projects at an opening through a wall, includes:

i) providing and rotatably connecting a pressure test cap to said terminal to engage an annular seal between the cap and on an end face of the tubular terminal, thereby to seal off said tubular terminal, ii) applying internal fluid pressure to the fitting to determine if any fitting leakage exists, iii) rotatably removing the pressure test cap from the terminal, iv) and providing and rotatably connecting a cover cap onto said tubular terminal to allow fluid leakage through the cover cap.

It will be understood, that the construction of the assembly is such as to allow associated use (application and removal) as described for both testing of the plumbing, and also for quick removal of 10 and quick installation of 40, as referred to.

A passage 50 in the skirt of 10*a* of the cap 10, allows for drainage of any water collecting in the cap, and the cap can be applied to direct passage 50 downwardly. See FIGS. 1 and 3. Air or bath water can enter via passage 50, as indicated by arrows 52.

We claim:

1. The method of pressure testing a plumbing fitting having a tubular terminal that projects at an opening through a wall, that includes i) providing and rotatably connecting a pressure test cap to said terminal to engage an annular seal between the cap and at an end face of the tubular terminal, thereby to seal off said tubular terminal, ii) applying internal fluid pressure to the fitting to determine if any fitting leakage exists, iii) rotatably removing said pressure test cap from the terminal, iv) and subsequently providing and rotatably connecting a cover cap onto said tubular terminal to allow fluid leakage through the cover cap, wherein said step iv) includes:

a) providing a retainer ring fitting on said tubular terminal and tightenable toward said wall, b) providing a series of retention cams on said ring and spaced about a longitudinal axis defined by the ring, there being gaps between successive cams, and there being retention shoulders on the cams, c) said retention shoulders provided to face in directions toward said wall, for retaining holders on the cover cap, after said holders have been passed longitudinally through said gaps and after the cover cap has been rotated to cause said holders to slidably engage the cams and become wedged against said shoulders.

2. The method of claim 1 including providing wrench flats on the ring and spaced axially from said cams, whereby the ring may be rotatably tightened by a wrench.

3. The method of claim 1 including locating said cover cap in a position of attachment to the cams, the cams received within said cap and the cap defining a fluid passing passage.

* * * * *